US005581148A

United States Patent [19]

Nakatani et al.

[11] Patent Number: 5,581,148

[45] Date of Patent: Dec. 3, 1996

[54] FLAT TYPE IMAGE DISPLAY APPARATUS AND FABRICATION METHOD THEREFOR

[75] Inventors: Toshifumi Nakatani, Moriguchi; Kanji Imai, Takatsuki; Tomohiro Sekiguchi, Kobe; Makoto Inada, Nara, all of Japan

[73] Assignee: Matsushita Electric Industrial Co., Ltd., Osaka, Japan

[21] Appl. No.: 278,659

[22] Filed: Jul. 21, 1994

[30] Foreign Application Priority Data

Oct. 1, 1993 [JP] Japan ..... 5-246861

[51] Int. Cl.[6] ..... H01J 63/04

[52] U.S. Cl. ..... 313/492; 313/238; 313/306; 313/513; 445/23; 29/825

[58] Field of Search ..... 313/243, 244, 313/306, 235, 422, 495, 513, 492; 445/23, 24; 29/825, 833

[56] References Cited

U.S. PATENT DOCUMENTS

| | | | |
|---|---|---|---|
| 3,445,711 | 5/1969 | Olson | 313/238 |
| 3,574,919 | 4/1971 | Reppert | 29/429 |
| 3,666,911 | 5/1972 | Armstrong | 219/91.22 |
| 3,756,891 | 9/1973 | Ryan | 156/313 |
| 3,936,697 | 2/1976 | Scott | 315/12.1 |
| 4,347,522 | 8/1982 | Bahl et al. | 347/76 |
| 4,493,666 | 1/1985 | Nonomura et al. | 445/24 |
| 4,517,489 | 5/1985 | Glock et al. | 313/422 |
| 4,597,636 | 7/1986 | Hoshikawa | 359/82 |
| 4,651,049 | 3/1987 | Saeki et al. | 313/355 |
| 4,955,681 | 9/1990 | Sekihara et al. | 313/495 |
| 5,021,018 | 6/1991 | Duback et al. | 445/24 |
| 5,068,961 | 12/1991 | Nishikawa | 29/825 |
| 5,094,642 | 3/1992 | Reichelt et al. | 445/33 |
| 5,104,343 | 4/1992 | Muragishi et al. | 445/25 |
| 5,120,384 | 6/1992 | Yoshimitsu et al. | 156/242 |
| 5,144,197 | 9/1992 | Peters et al. | 313/422 |
| 5,189,335 | 2/1993 | Sekihara et al. | 313/422 |
| 5,247,225 | 9/1993 | Nakatani et al. | 313/495 |
| 5,272,413 | 12/1993 | Yamazaki et al. | 313/495 |
| 5,389,191 | 2/1995 | Muramatsu et al. | 156/510 |
| 5,412,867 | 5/1995 | Aikawa et al. | 29/825 |
| 5,457,880 | 10/1995 | McKinley et al. | 29/833 |

FOREIGN PATENT DOCUMENTS

| | | | |
|---|---|---|---|
| 0050295 | 4/1982 | European Pat. Off. | H01J 29/02 |
| 0316871 | 5/1989 | European Pat. Off. | H01J 31/12 |
| 61-230250 | 10/1986 | Japan | H01J 31/12 |
| 62-272431 | 11/1987 | Japan | H01J 31/12 |

OTHER PUBLICATIONS

Feinwerktechnik & Messtechnik, "Metallsteuerscheiben–eine neue Technologie", pp. 335–338 (Aug. 1991).

*Primary Examiner*—Alvin E. Oberly
*Assistant Examiner*—Lawrence O. Richardson
*Attorney, Agent, or Firm*—Panitch Schwarze Jacobs & Nadel, P.C.

[57] ABSTRACT

A novel electrode unit includes a plurality of linear cathodes and a plurality of flat-shaped electrodes. Each of the electrodes has a plurality of identification holes. The relative positional relationship of the identification holes is uniform with regard to each of the electrodes. However, the positions of the identification holes are shifted from those of adjacent electrodes by a predetermined interval so that a line connecting centers of the ID holes is parallel or perpendicular to a longitudinal direction of the linear cathodes when the electrodes are piled up and evenly aligned. The identification holes allow the electrodes to be accurately positioned with respect to each other when assembling the electrodes into the electrode unit. Each of the electrodes also includes a temporary fixing part at an area indented from an outer circumference of the electrode. During assembly of an electrode unit, the temporary fixing part is fixed to a temporary fixing part of an adjacent electrode via a spacer. Upon completion of a permanent fixing procedure between the two electrodes, the temporary fixing part is removed.

6 Claims, 10 Drawing Sheets

FLAT TYPE IMAGE DISPLAY APPARATUS AND FABRICATION METHOD THEREFOR

FIELD OF THE INVENTION AND RELATED ART STATEMENT

1. Field of the Invention

The present invention relates to a flat type image display apparatus which is mainly used for a TV set or a visual display terminal for computers and its fabrication method.

2. Description of the Related Art

In a known flat type image display apparatus, an electron beam emitted from an electron beam source is controlled (i.e., focussed, modulated and deflected) by a flat sheet-shaped electrode unit. This flat sheet-shaped electrode unit consists of plural electron beam control electrodes which are formed into a lamination body. After steps of focussing, modulating and deflection, the electron beam reaches a phosphor screen. The phosphor screen thereby emits light and forms an image thereon.

FIG. 15 is an exploded perspective view showing general construction of the conventional flat type image display apparatus 101. The image display apparatus 101 has a vacuum case constituted by a front panel 103, a rear panel 104 and a side wall part (not shown). A phosphor screen 102 is formed on an inner face of the front panel 103. An inbetween space defined by the front panel 103, the side wall part and the rear panel 104 is kept vacuum. A back electrode 105, plural linear cathodes 106 and a flat-shaped electrode unit 107 are provided from the back panel 104 toward the front panel 103. The linear cathodes 106 act as an electron beam source. The back electrode 105 is formed on an inner face of the back panel 104. The electrode unit 107 consists of an electron beam extracting electrode 107*a*, a modulation electrode 107*b*, a vertical focussing electrode 107*c*, a horizontal focussing electrode 107*d*, a horizontal deflection electrode 107*e*, a shield electrode 107*f* and a vertical deflection electrode 107*g*.

Electron beams emitted from the linear cathode 106 pass through the electron beam extracting electrode 107*a*, the modulation electrode 107*b*, the vertical focussing electrode 107*c*, the horizontal focussing electrode 107*d*, the horizontal deflection electrode 107*e*, the shield electrode 107*f* and the vertical deflection electrode 107*g*, thereby getting focussed, modulated and deflected. Finally, a stream of the electron beams reaches a predetermined position on the phosphor screen 102, and thereby the screen emits light to make an image.

In the electrode unit 107, the respective electrodes 107*a*–107*g* are bonded with each other with each predetermined gap held therebetween, and they are electrically insulated from each other. As an example, a method for bonding the shield electrode 107*f* and the vertical deflection electrode 107*g* will be described with reference to FIG. 16.

The shield electrode 107*f* and the vertical deflection electrode 107*g* are bonded with each other with insulation therebetween held by insulative bonding members 108. Each of the insulative bonding members 108 includes a pair of bonding glass members 108*a* and a spacer glass member 108*b* for securing a predetermined gap between the electrodes 107*f* and 107*g*. A melting temperature of the spacer glass member 108*b* is higher than that of the bonding glass member 108*a*.

A substrate 109 and a stamper 110 constitute an electrode bonding tool by a baking process. The substrate 109 has plural positioning pins 111 for disposing the respective electrodes 107*f* and 107*g* in position. A metal sheet 112*a*, which is for mainly protecting the electrode 107*g*, is provided between the electrode 107*g* and the substrate 109, and a metal sheet 112*b* for mainly protecting the electrode 107*f* is provided between the electrode 107*f* and the stamper 110.

After disposing the metal sheet 112*a* on the substrate 109, the vertical deflection electrode 107*g* is mounted on the metal sheet 112*a* with the pins 111 passing through positioning holes 107*ga* of the electrode 107*g*. The vertical deflection electrode 107*g* is thus disposed on the metal sheet 112*a*. Next, the insulative bonding members 108 are put on respective predetermined positions of the vertical deflection electrode 107*g*. The shield electrode 107*f* is disposed on the insulative bonding members 108 with the pins 111 passing through the positioning hole 107*f*. After disposing the metal sheet 112*b* on the shield electrode 107*f*, the stamper 110 is disposed on the metal sheet 112*b*.

The above-mentioned assembly is heated in a baking oven at the temperature of 450° C. to 500° C., thereby melting and crystallizing the bonding glass members 108*a*. Thus, the shield electrode 107*f* and the vertical deflection electrode 107*g* are bonded with each other with their insulation held from each other.

In a similar way to the above, the horizontal focussing electrode 107*d* and the horizontal deflection electrode 107*e* are bonded with each other, keeping a state that they are insulated from each other. Further, the modulation electrode 107*b* and the vertical focussing electrode 107*c* are bonded with each other, keeping a state that they are insulated from each other. Finally, the above-mentioned three bonded units and the electron beam extracting electrode 107*a* are bonded with each other with respective insulation held from each other, thus completing fabrication of the electrode unit 107.

In the above-mentioned conventional construction of the flat type image display apparatus, it is very delicate to precisely locate the respective electrodes, which constitute the electrode unit 107, in position. It is actually impossible to make such a precise positioning of the respective electrode since an accuracy of the positioning is dependent on an uncertain engaging accuracy between the positioning pin 111 and the positioning hole 107*fa* or 107*ga*. To obtain a fine accuracy of the positioning, it is required to produce the positioning pin 111 and the positioning holes 107*fa*, 107*fg* with very high accuracy. However, such a very high working accuracy is incompatible with the mass production.

OBJECT AND SUMMARY OF THE INVENTION

An object of the present invention is to offer a flat type image display apparatus in which plural electrodes can be positioned with very fine accuracy without spoiling the mass-productivity.

In order to achieve the above-mentioned object, the flat type image display apparatus of the present invention comprises:

a vacuum case which defines a vacuum space between a front panel having a phosphor screen on an inner face thereof and a rear panel;

a plurality of linear cathodes mounted in the vacuum case; and an electrode unit mounted in the vacuum case and including a plurality of flat-shaped electrodes bonded with and insulated from each other, the flat-shaped electrodes each having a plurality of identification holes, a relative positional relationship of the identification holes being uniform with regard to every flat-shaped electrode, positions of the identification holes being shifted in a predetermined direction from those of adjacent flat-shaped electrodes.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, a preferred embodiment of the present invention is described with reference to the accompanying drawings.

Figure 1:
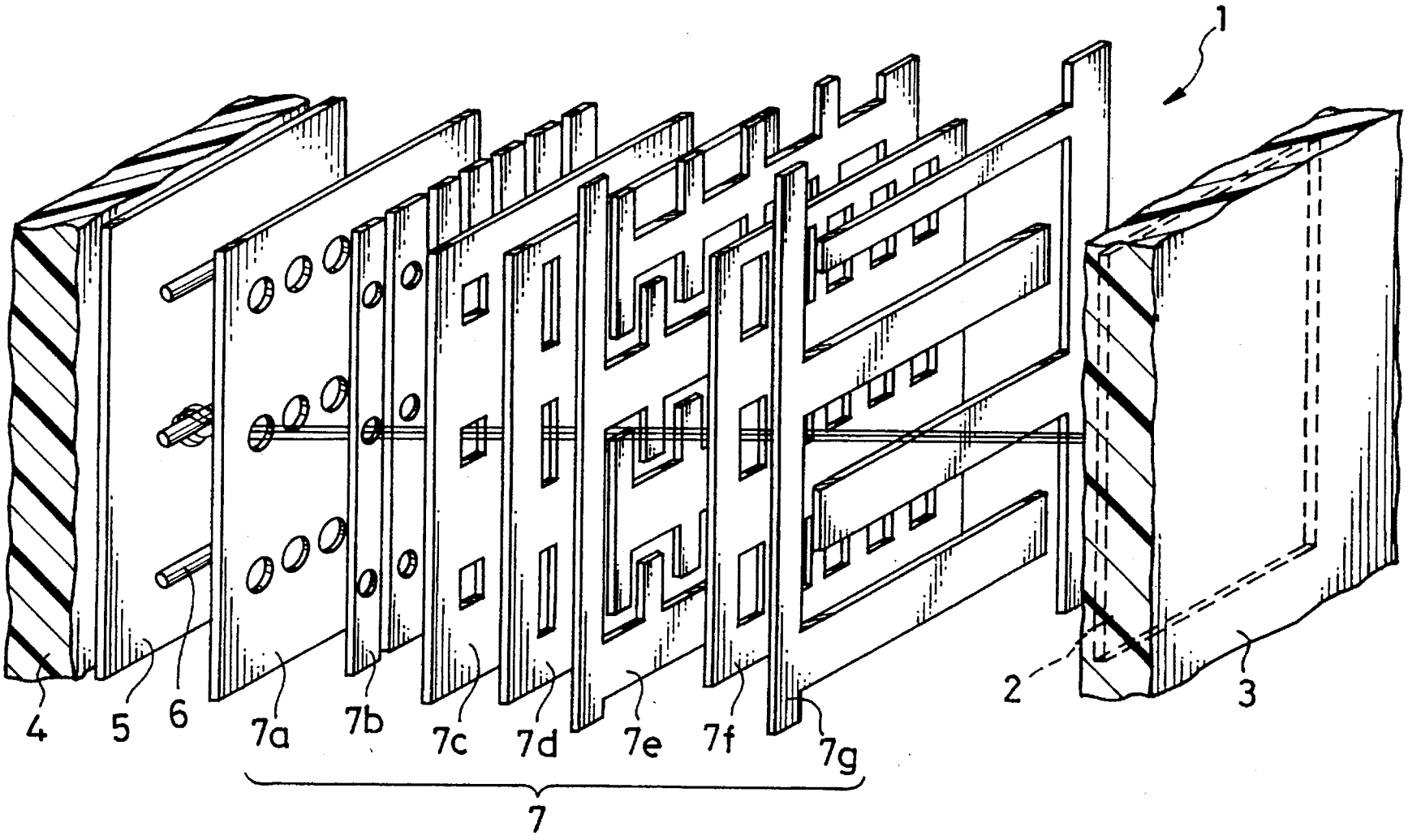
FIG. 1 is an exploded perspective view showing a flat type image display apparatus of the present invention.

FIG. 1 is an exploded perspective view showing a flat type image display apparatus 1. The image display apparatus 1 has a vacuum case constituted by a front panel 3, a rear panel 4 and a side wall part (not shown). A phosphor screen 2 is formed on an inner face of the front panel 3. An inbetween space defined by the front panel 3, the side wall part and the rear panel 4 is kept vacuum. A back electrode 5, plural linear cathodes 6 and a flat-shaped electrode unit 7 are provided from the back panel 4 toward the front panel 3. The linear cathodes 6 act as an electron beam source. The back electrode 5 is formed on an inner face of the back panel 4. The electrode unit 7 consists of an electron beam extracting electrode 7*a*, a modulation electrode 7*b*, a vertical focussing electrode 7*c*, a horizontal focussing electrode 7*d*, a horizontal deflection electrode 7*e*, a shield electrode 7*f* and a vertical deflection electrode 7*g*. These electrodes 7*a*–7*g* are disposed substantially in parallel with each other in a direction from the back panel 4 toward the front panel 3.

Electron beams emitted from the linear cathode 6 pass through the electron beam extracting electrode 7*a*, the modulation electrode 7*b*, the vertical focussing electrode 7*c*, the horizontal focussing electrode 7*d*, the horizontal deflection electrode 7*e*, the shield electrode 7*f* and the vertical deflection electrode 7*g*, thereby getting focussed, modulated and deflected. Finally, a stream of the electron beams reaches a predetermined position on the phosphor screen 2, and thereby the screen emits light to make an image.

Figure 2:
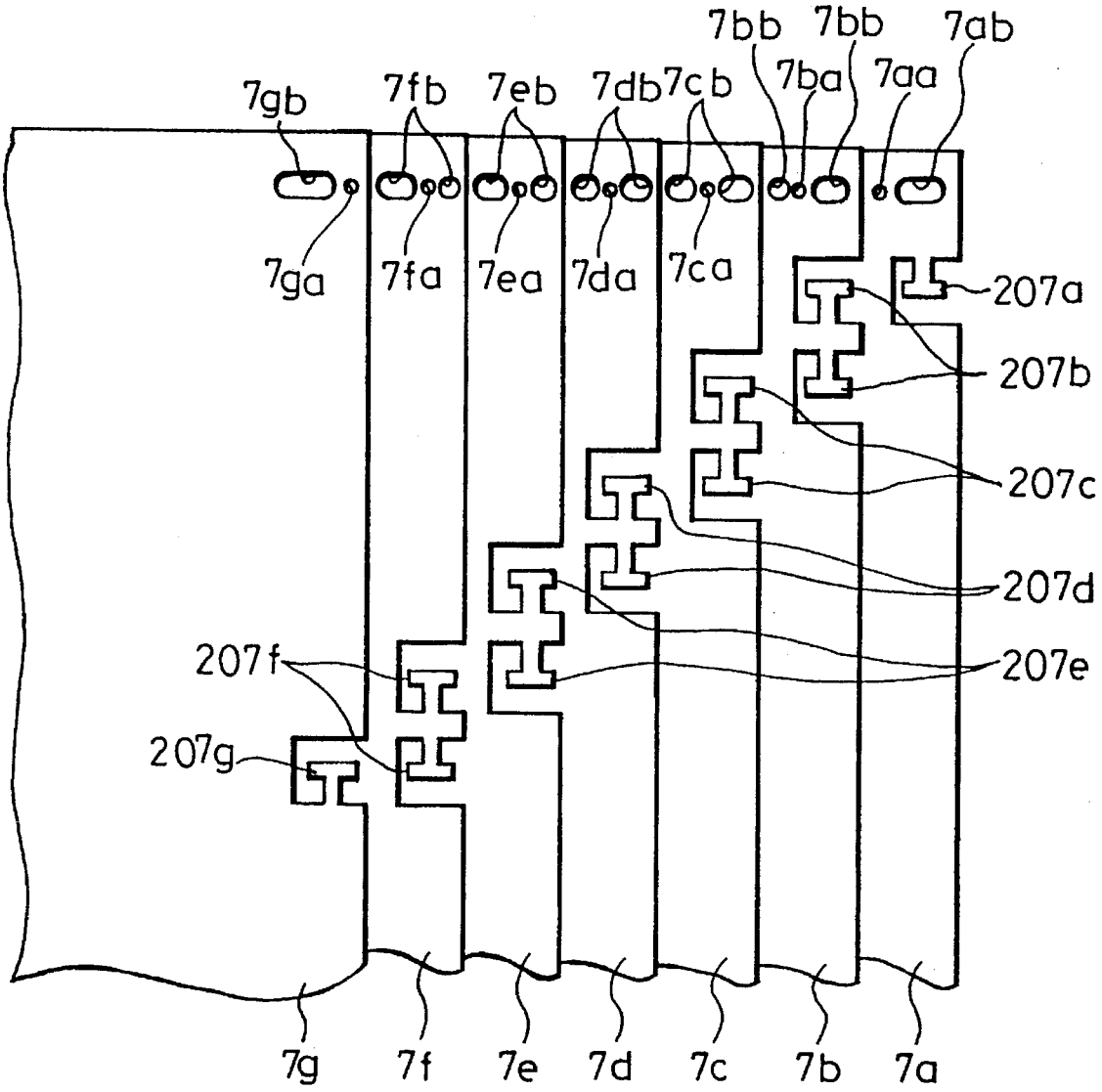
FIG. 2 is a plan view showing seven sheets of the electrodes of the present invention.

FIG. 2 is a plan view showing seven sheets of the electrodes 7*a*–7*g* which are piled up on a table (not shown) with a predetermined shift from each other in the horizontal direction (the widthwise direction in the figure). The horizontal direction implies a direction of the horizontal scanning with regard to the phosphor screen 2. The figure shows only one corner part of each of the electrodes 7*a*–7*g*. The electrodes 7*a*, 7*b*, 7*c*, 7*d*, 7*e*, 7*f* and 7*g* have identification holes 7*aa*, 7*ba*, 7*ca*, 7*da*, 7*ea*, 7*fa* and 7*ga*, respectively. Further, the electron beam extracting electrode 7*a* has a sight hole 7*ab*. The modulation electrode 7*b* has a pair of sight holes 7*bb*. The vertical focussing electrode 7*c* has a pair of sight holes 7*cb*. The horizontal focussing electrode 7*d* has a pair of sight holes 7*db*. The horizontal deflection electrode 7*e* has a pair of sight holes 7*eb*. The shield electrode 7*f* has a pair of sight holes 7*fb*. The horizontal deflection electrode 7*g* has a sight hole 7*gb*. Also, the electrodes 7*a*, 7*b*, 7*c*, 7*d*, 7*e*, 7*f* and 7*g* have temporary fixing parts 207*a*, 207*b*, 207*c*, 207*d*, 207*e*, 207*f* and 207*g*, respectively. In the figure, illustration of the configuration for passing electron beams through each of the electrodes 7*a*–7*g* is omitted for simplification of the drawing.

Figure 3:
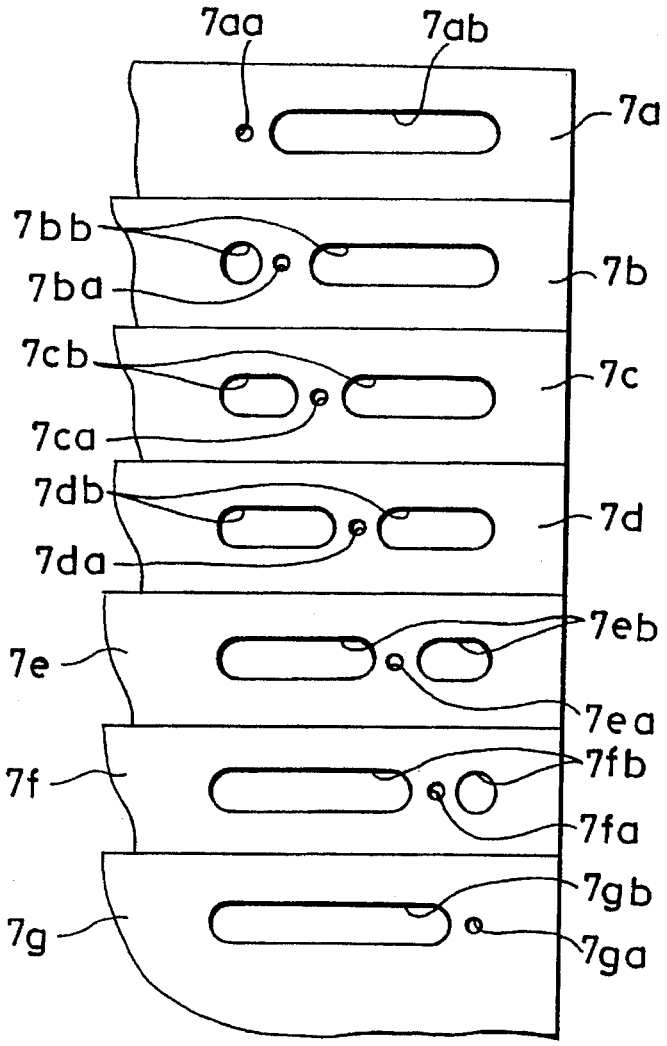
FIG. 3 is a plan view showing only corner parts of the seven electrodes shown in FIG. 2.

FIG. 3 is a plan view showing only the corner parts of the seven electrodes 7*a*–7*g* which are piled up on the table with a predetermined shift from each other in the vertical direction. The vertical direction implies a direction of the vertical scanning with regard to the phosphor screen 2. Each of the identification holes 7*aa*, 7*ba*, 7*ca*, 7*da*, 7*ea*, 7*fa* and 7*ga* and each of the sight holes 7*ab*, 7*bb*, 7*cb*, 7*db*, 7*eb*, 7*fb* and 7*gb* are formed in every corner of each of the electrodes 7*a*–7*g* in such manner that each identification hole and each sight hole make parallel translations toward the other three corners (right-lower, left-upper and left-lower corners) of each electrode.

Figure 4:
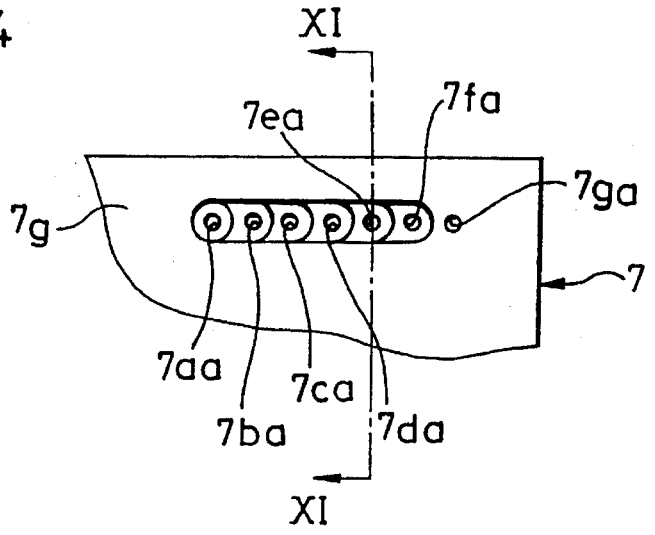
FIG. 4 is a plan view showing seven electrodes piled up in an order shown in FIG. 3.

In one electrode (e.g., 7*a*), four identification holes (e.g., 7*aa* of four corners) are located to hold a predetermined relative positional relationship i.e., a horizontal interval and a vertical interval among them. This relative positional relationship is uniform with regard to all electrodes 7*a*–7*g*. As to a positional relationship of the identification holes 7*aa*–7*ga* among the electrodes 7*a*–7*g*, positions of the identification holes 7*aa*–7*ga* in the vertical direction coincide with each other, and their positions in the horizontal direction have a predetermined shift from each other. In this embodiment, the above-mentioned shift is uniformly 1 mm. Each of the identification holes *7aa–7ga* is provided in a position included by a common area defined by six of the sight holes *7ab–7gb* of other electrodes. For example, a position of the identification hole *7aa* is in an area defined by the left-side sight holes *7bb*, *7cb*, *7db*, *7eb* and *7fb* in FIG. 3 and the sight hole *7gb* at the time when the seven electrodes *7a–7g* are piled up to complete the electrode unit 7 as shown in FIG. 4. Also, position of the identification hole *7ba* is in an area defined by the left-side sight holes *7cb*, *7db*, *7eb*, *7fb* and the sight holes *7gb*, *7ab* when the electrodes *7a–7g* are piled up to complete the electrode unit 7. In a similar way to the above, the identification holes *7ca*, *7da*, *7ea* and *7fa* appear through the sight holes *7ab–7gb* (excluding *7cb*), *7ab–7gb* (excluding *7db*), *7ab–7gb* (excluding *7eb*) and *7ab–7gb* (excluding *7fb*), respectively. Thus, as shown in FIG. 4, the respective identification holes *7aa–7ga* are visible independently from each other.

As a result, all the identification holes *7aa–7ga* shown in FIG. 4 are through-holes in the electron-beam traveling direction which is perpendicular to a sheet surface of FIG. 4.

By providing the electrodes *7a–7g* with the sight holes *7ab–7gb* each having the form elongated in the horizontal direction and corresponding to the identification holes *7aa–7ga*, a total area in which the identification holes *7aa–7ga* and the sight holes *7ab–7gb* are aligned could be made smaller than a total area in which sight holes are formed independently from each other.

Figure 5:
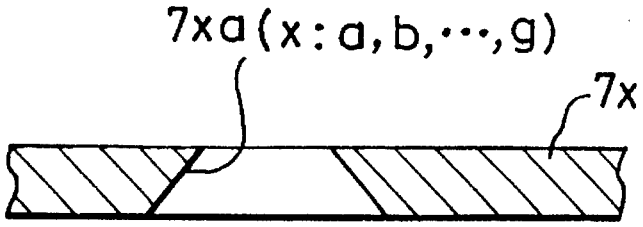
FIG. 5 is a cross-sectional view showing an identification hole shown in FIGS. 2, 3 and 4.

In this embodiment, detection of the identification holes *7aa–7ga* is carried out by means of an optical microscope. By making a uniform pitch between the adjacent two of the identification holes *7aa–7ga*, four sets of optical microscopes can be used as one unit microscope. Therefore, mechanically-originated deterioration in accuracy for the positioning is made minimum. Besides, since the identification holes *7aa–7ga* are of through-holes, an edge of each of the identification holes *7aa–7ga* can surely be detected by a transmitted light which has passed through the identification holes *7aa–7ga*. An accuracy in the position detection is thus improved. FIG. 5 is a cross-sectional view showing the identification holes *7xa* (x: a, b, . . . , g). As shown in FIG. 5, inner walls of the identification hole *7xa* are formed into a conically bored shape, thereby to improve the accuracy in detecting a position of the identification hole *7xa*.

Figure 6:
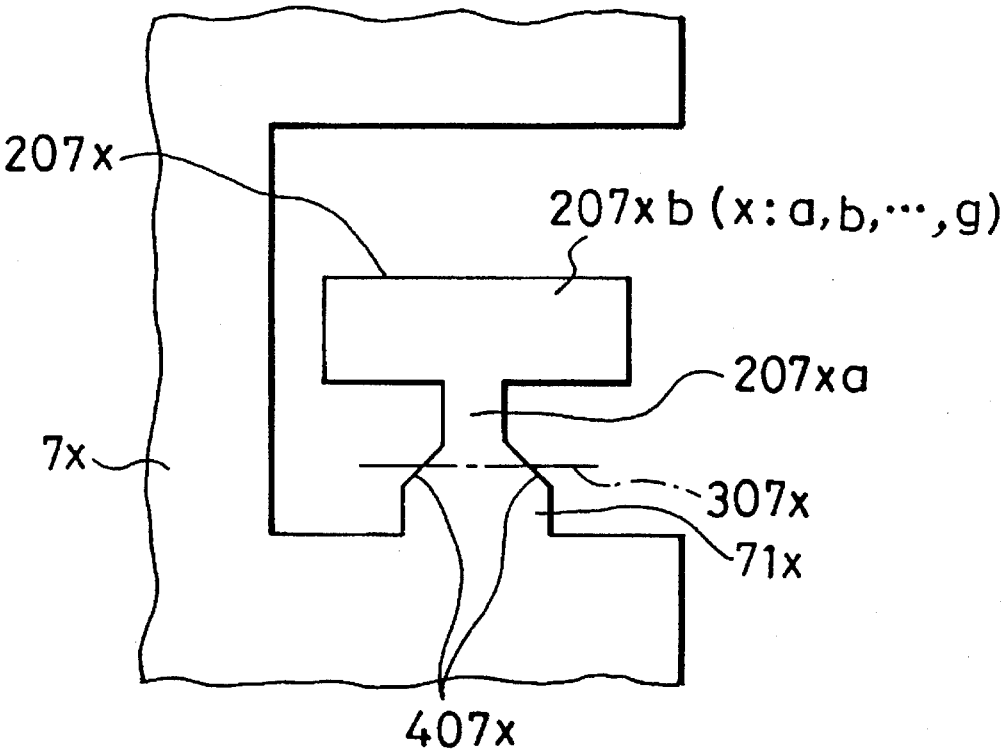
FIG. 6 is a plan view showing a detail of a temporary fixing part in the present invention.

FIG. 6 is a plan view showing a detail of the temporary fixing part 207*x* (x: a, b, . . . , g) shown in FIG. 2. This figure (FIG. 6) shows one typical configuration. In FIG. 2, although illustration is limited to one (right-upper corner) of four corners of the electrodes *7a–7g*, the temporary fixing parts 207*a*–207*g* are provided in the other three corners of each of the electrodes *7a–7g*. The configuration of the temporary fixing parts 207*a*–207*g* is also provided in the right-lower corner of the electrodes *7a–7g* in a manner that the configuration of the temporary fixing parts 207*a*–207*g* makes parallel translations toward the right-lower corner of the electrodes *7a–7g*, respectively. The configuration of the temporary fixing parts in the left half of the electrodes *7a–7g* is symmetric with respect to a vertical (lengthwise direction in FIG. 2) centerline (not shown) of each of the electrodes *7a–7g*. Positional relationship between the right and left temporary fixing parts may be shifted by a certain value in the vertical (lengthwise in the figure) direction.

In FIG. 6, the temporary fixing part 207*x* is disposed inside the electrode *7x*. The temporary fixing part 207*x* has a fixing portion 207*xb* and an elastic portion 207*xa*. Although these portions 207*xa* and 207*xb* are members of the electrode *7x* at this state, they (207*xa*, 207*xb*) are removed after completion of the permanent bonding as described later. The electrode *7x* has slanted edges 407*x* at a base portion 71*x* of the elastic portion 207*xa*. A chain line 307*x* shows a cut-off line of the temporary fixing part 207*x* which is to be removed from the electrode *7x*. When the temporary fixing part 207*x* was removed from the electrode *7x* at the line 307*x*, existence of the slanted edges 407*x* is significant in a standpoint that only obtuse angle edges are left in the base portion 71*x* of the electrode *7x*. If an acute angle edge were left, there would arise a problem that an electric discharge occurs when a high voltage is applied to the phosphor screen 2 (FIG. 1).

Next, a method for bonding the electrode unit 7 will be described.

As shown in FIG. 1, the electrode unit 7 is made by bonding respective electrodes *7a–7g* to each other with the respective predetermined intervals secured therebetween, while the electrical insulation is kept from each other. As an example, a method for bonding the shield electrode *7f* and the vertical deflection electrode *7g* will be described hereinafter with reference to FIGS. 7, 8, 9 and 10.

Figure 7:
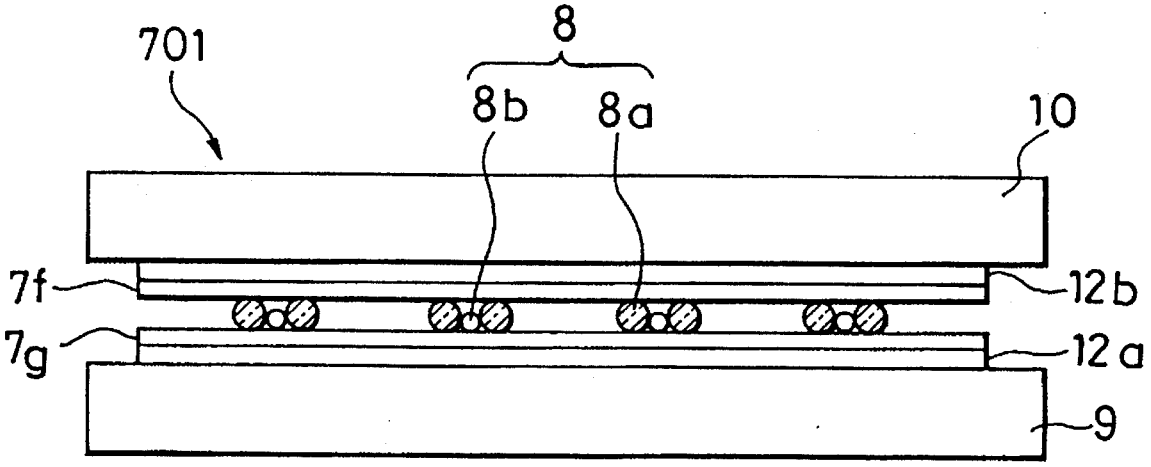
FIG. 7 is a side view showing a bonding process of a shield electrode 7*f* and a vertical deflection electrode 7*g* in the present invention.
Figure 8:
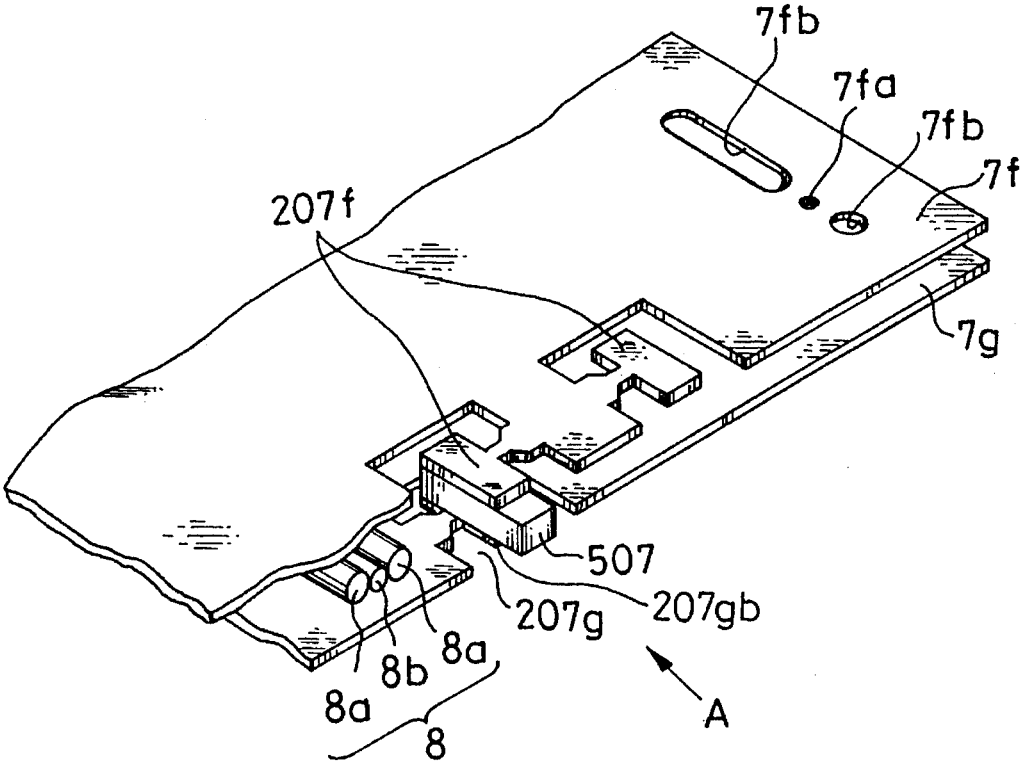
FIG. 8 is a perspective view showing a main part including a temporary fixing parts 207*f* and 207*g* in the present invention.
Figure 9:
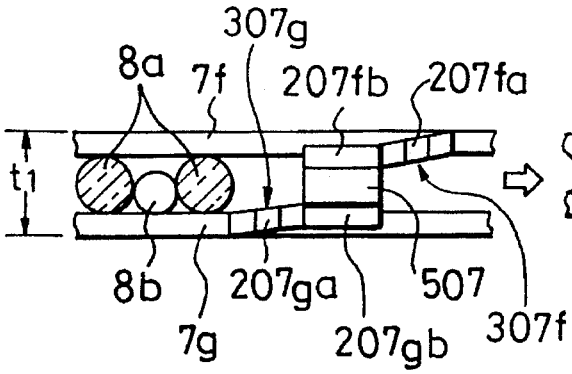
FIG. 9 is a side view seen from "A" in FIG. 8 before a bonding process.
Figure 10:
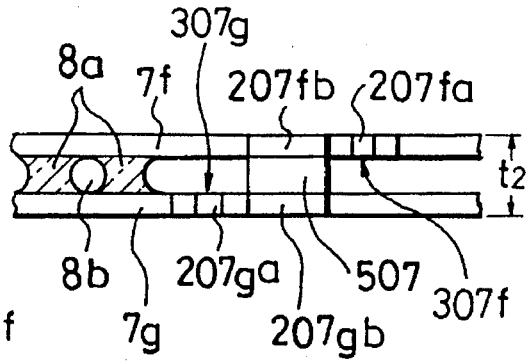
FIG. 10 is a side view seen from "A" in FIG. 8 after the bonding process.

FIG. 7 is a side view showing a bonding process of the shield electrode *7f* and the vertical deflection electrode *7g* with an electrode bonding tool (9, 10). FIG. 8 is a perspective view showing a main part including the temporary fixing parts 207*f* and 207*g*. FIG. 9 and FIG. 10 are side views seen from "A" in FIG. 8 before and after the bonding process, respectively. In FIG. 7, the shield electrode *7f* and the vertical deflection electrode *7g* are insulated from and bonded with each other by an insulative bonding material 8. This insulative bonding material 8 includes a bonding glass member 8*a* and a spacer glass member 8*b* for making a predetermined gap between the electrodes *7f* and *7g*. The spacer glass member 8*b* is put between a pair of bonding glass members 8*a*. A substrate 9 and a stamper 10 constitute the aforementioned electrode bonding tool by a baking process. A metal sheet 12*a* for mainly protecting the vertical deflection electrode *7g* is provided between the substrate 9 and the vertical deflection electrode *7g*, and a metal sheet 12*b* for mainly protecting the shield electrode *7f* is provided between the stamper 10 and the shield electrode *7f*.

First, in FIG. 7, the metal sheet 12*a* and the vertical deflection electrode *7g* are mounted on the substrate 9. The insulative bonding materials 8 are put on predetermined positions on the vertical deflection electrode *7g*. Next, in FIG. 8, a temporary fixing spacer 507 is put on the fixing portion 207*gb* of the temporary fixing part 207*g*, and the shield electrode *7f* is mounted on the insulative bonding materials 8.

In this state, four identification holes *7fa* formed in respective corners of the shield electrode *7f* can be detected by the four optical microscopes, respectively. Also, four identification holes *7ga* (FIG. 3) formed in respective corners of the vertical deflection electrode *7g* can be detected. To make an optimum positional relationship between the identification holes *7ga* and *7fa*, position of at least one of the electrodes *7g* and *7f* is corrected in compliance with calculation results for minimizing a deviation of each interval between the identification holes *7ga* and *7fa*.

After completion of the above-mentioned position correction, the fixing portion 207*fb* of the shield electrode *7f* and the fixing portion 207*gb* of the vertical deflection electrode *7g* are bonded with each other as shown in FIG. 9 via the temporary fixing spacer 507 by means of a known bonding method such as spot welding.

In FIG. 9, a thickness $t_s$[μm] of the temporary fixing spacer 507 has the following relation:

$$t_{8b}-50 \leq t_s \leq t_{8a}+50$$

wherein $t_{8a}$ represents a thickness of the bonding glass member 8*a* before the melting process, and $t_{8b}$ represents a thickness of the spacer glass member 8*b*.

Further, inventors empirically confirmed that the following relation is desirable:

$$t_{8b}-25 \leq t_s \leq (t_{8a}-t_{8b})/2.$$

Next, in FIG. 7, the protection metal sheet 12*b* is mounted on the shield electrode 7*f*, and the stamper 10 is put on the protection metal sheet 12*b*, thereby constituting a baking assembly 701.

This baking assembly 701 is heated in an oven (not shown) at the temperature of 450° to 500° C. The bonding glass members 8*a* are thereby melted and crystallized. By the crystallization, the bonding glass members 8*a* keep a tight bonding state even when they are heated again up to the melting temperature at the subsequent steps. Thus, the shield electrode 7*f* and the vertical deflection electrode 7*g* are tightly bonded with each other as shown in FIG. 10.

After completion of the above-mentioned "permanent" bonding process, the fixing portions 207*fb*, 207*gb* and the elastic portions 207*fa*, 207*gb* are removed at the respective cut-off lines 307*f* and 307*g* from the electrodes 7*f* and 7*g*, respectively. Thus, insulative bonding process of the electrodes 7*f* and 7*g* is completed.

As is apparent from FIGS. 9 and 10, a total thickness t1 before the permanent bonding process decreases to a thickness t2 after the permanent bonding process. The elastic portions 207*fa* and 207*ga* of the respective temporary fixing parts 207*f* and 207*g* follow this change in thickness to restore the bend of themselves, thereby preventing a positional deviation between the electrodes 7*f* and 7*g* which may be caused by the melting process.

In a similar way to the above, the horizontal focussing electrode 7*d* and the horizontal deflection electrode 7*e* are bonded to each other, keeping the insulation therebetween. Also, the modulation electrode 7*b* and the vertical focussing electrode 7*c* are bonded to each other, keeping the insulation therebetween. Finally, three units, whose bonding processes have been completed, and the electron beam extracting electrode 7*a* are bonded with and insulated from each other via the insulative bonding materials 8. The electrode unit 7 is thus completed.

Figure 11:
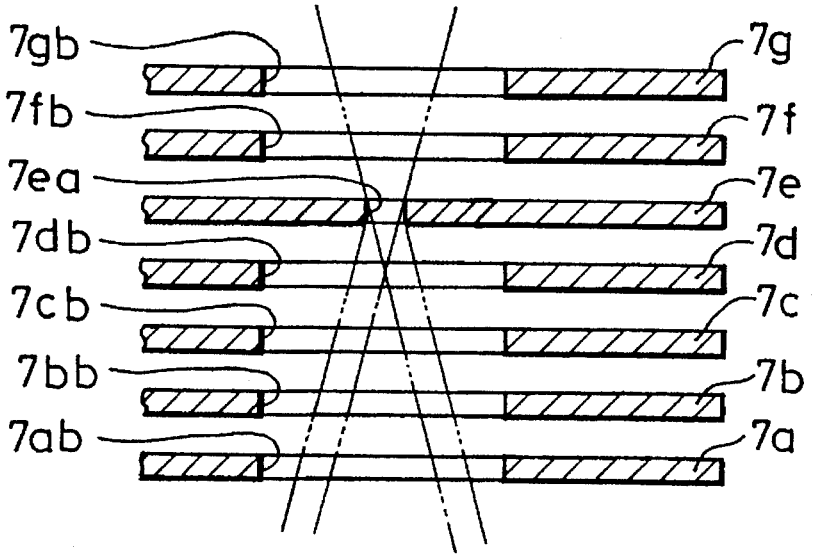
FIG. 11 a cross-sectional view showing seven electrodes taken on line XI—XI in FIG. 4.

Hereupon, FIG. 11 is a cross-sectional view showing seven electrodes 7*a*–7*g* taken on line XI—XI in FIG. 4. Chain lines represent light beams with which the electrodes 7*a*–7*g* are irradiated from the side of the electrode 7*a* or 7*g*. As is apparent from FIGS. 4 and 11, a width of each of the sight holes 7*ab*, 7*bb*, 7*cb*, 7*db*, 7*fb* and 7*gb* is larger than a diameter of the identification hole 7*ea*. The diameters of six sight holes 7*ab*, 7*bb*, 7*cb*, 7*db*, 7*fb* and 7*gb* are equal to each other. The diameter is of a size which allow the light beams to pass therethrough when the identification hole is located in the end electrode (i.e., the electrode 7*a* or 7*g*) of the electrode unit. Next, another configuration of the identification hole 7*xa* and the sight holes 7*xb* will be described.

Figure 12:
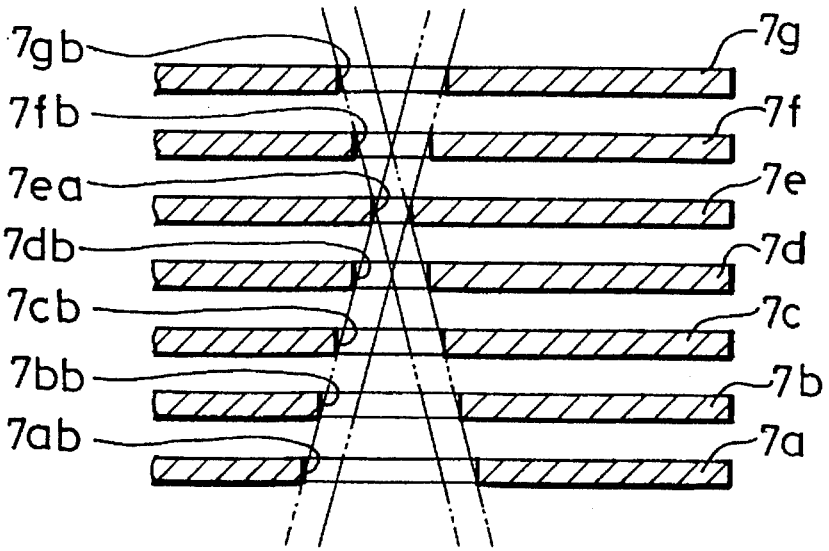
FIG. 12 is a cross-sectional view showing another configuration of an identification hole and sight holes in the present invention.

FIG. 12 is a cross-sectional view showing another configuration of the identification hole 7*ea* and the sight holes 7*ab*, 7*bb*, 7*cb*, 7*db*, 7*fb* and 7*gb*. As is apparent from comparison with FIG. 11, the more the sight hole 7*ab*, 7*bb*, 7*cb*, 7*db*, 7*fb* or 7*gb* is away from the identification hole 7*ea*, the larger a width of the sight hole 7*ab*, 7*bb*, 7*cb*, 7*db*, 7*fb* or 7*gb* becomes. Therefore, light beams represented by chain lines pass through only a minimum space defined by edges of the sight holes 7*ab*, 7*bb*, 7*cb*, 7*db*, 7*fb*, 7*gb* and the hole 7*ea*.

Figure 13:
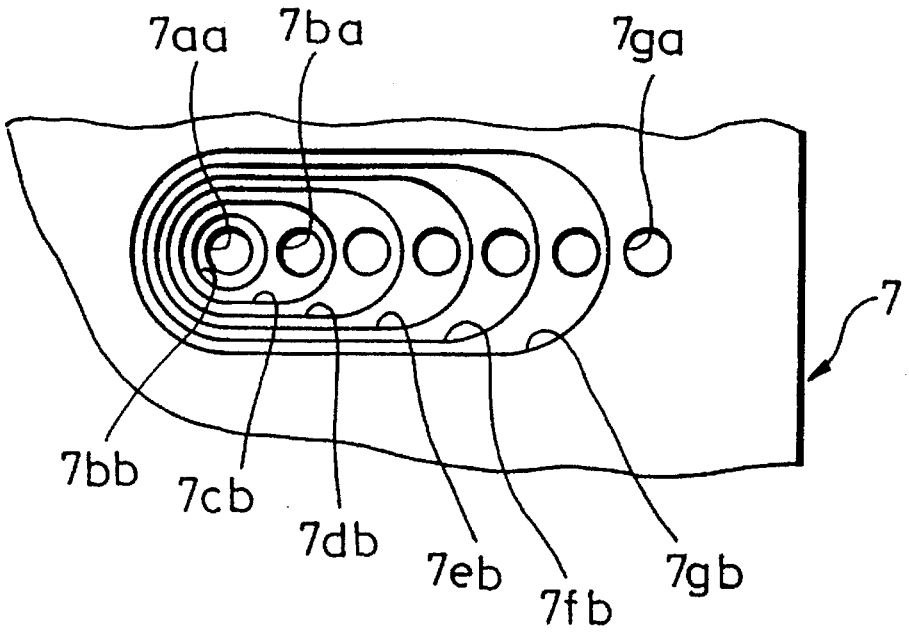
FIG. 13 is a plan view showing another configuration of identification holes and sight holes in the present invention when seven electrodes are superimposed.
Figure 14:
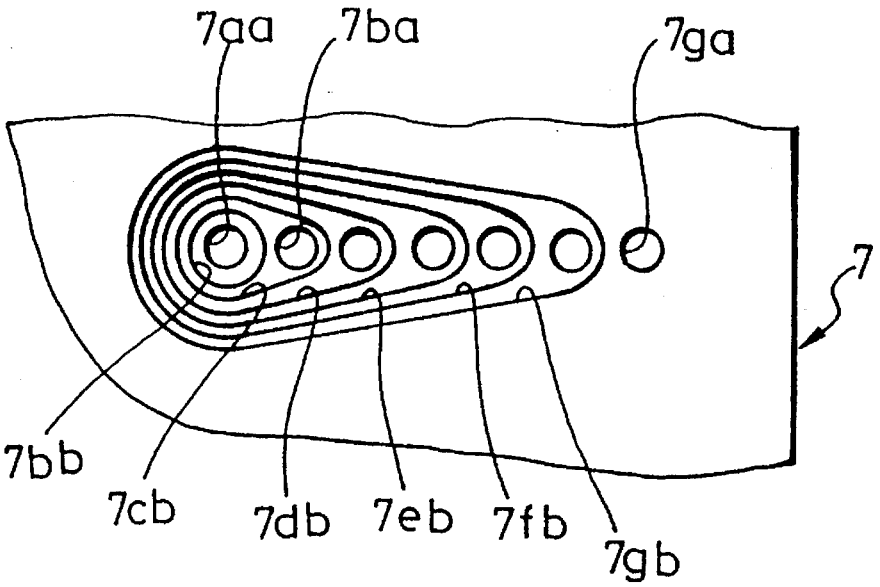
FIG. 14 is a plan view showing the other configuration of identification holes and sight holes in the present invention when seven electrodes are superimposed.
Figure 15:
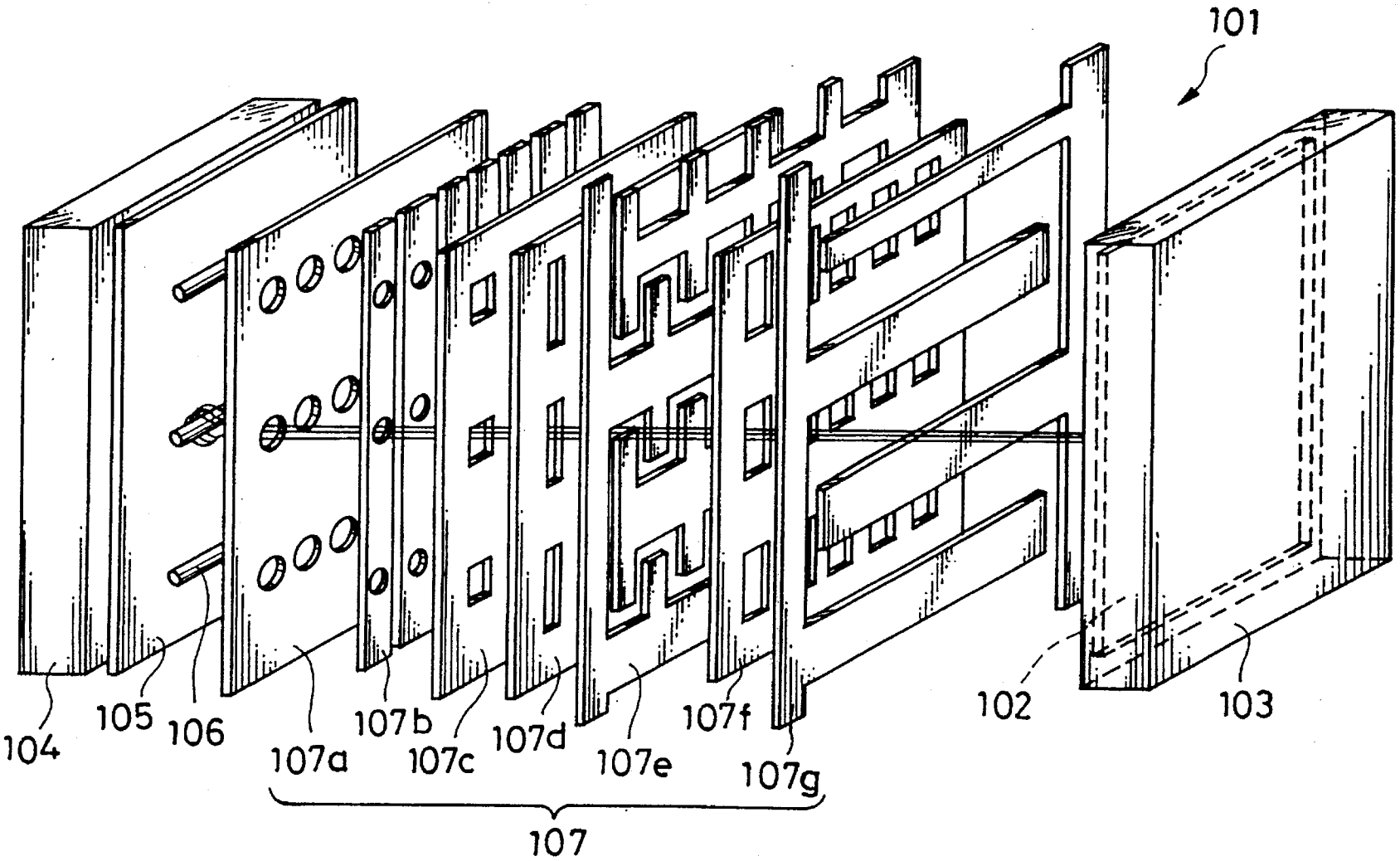
FIG. 15 (Prior Art)
FIG. 15 is an exploded perspective view showing a general construction of the conventional flat type image display apparatus.
Figure 16:
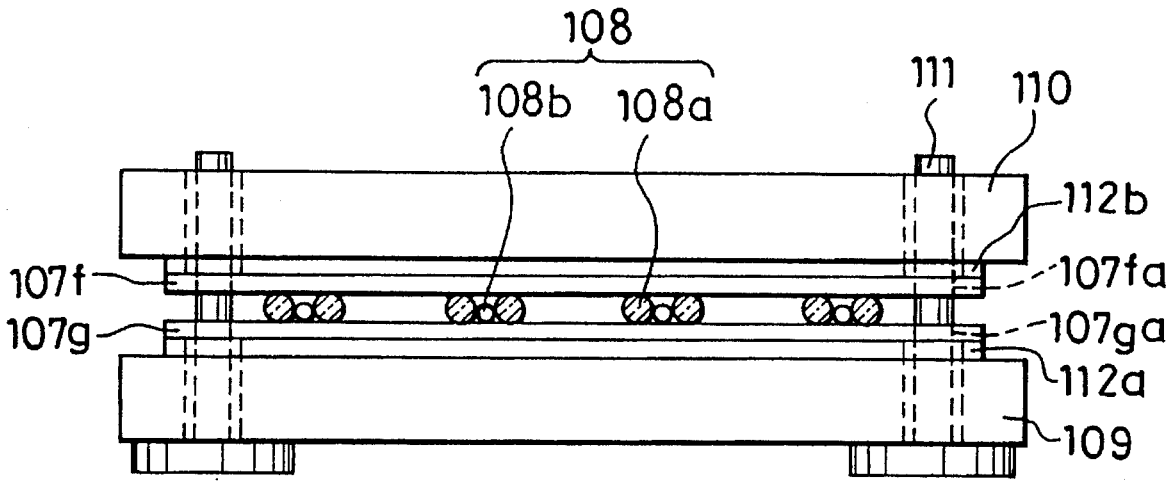
FIG.16 (Prior Art)
FIG. 16 is a side view showing the conventional bonding method of the electrodes.

To partially or wholly realize the above-mentioned configuration shown in FIG. 12, a configuration of the electrode unit 7 in a plan view can be formed as shown in FIG. 13 or FIG. 14. According to the configuration of FIG. 13 or FIG. 14, a cut-off area of the electrode for making the sight hole is made smaller than that of the configuration shown in FIG. 4. Therefore, it is avoidable to undesirably weaken a mechanical strength of the electrode in its peripheral part.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A flat type image display apparatus comprising:

a vacuum case which defines a vacuum space between a front panel having a phosphor screen on an inner face thereof and a rear panel;

a plurality of linear cathodes mounted in said vacuum case; and an electrode unit mounted in said vacuum case and including a plurality of flat-shaped electrodes bonded with and insulated from each other, said flat-shaped electrodes each having a plurality of identification holes, a relative positional relationship of said identification holes being uniform with regard to every flat-shaped electrode, positions of said identification holes being shifted from those of adjacent flat-shaped electrodes by a predetermined interval so that a line connecting centers of said ID holes is parallel or perpendicular to a longitudinal direction of said linear cathodes when said electrodes are piled up and evenly aligned.

2. A flat type image display apparatus in accordance with claim 1, wherein each of said electrodes has at least one sight hole associated with each of said identification holes, and said at least one sight hole defines an aperture area which includes a position of an identification hole formed in an adjacent electrode when said electrodes are piled up and evenly aligned.

3. A flat type image display apparatus in accordance with claim 2, wherein a width of said at least one sight hole is made equal to that of an adjacent sight hole.

4. A flat type image display apparatus in accordance with claim 2, wherein a width of said at least one sight hole is made gradually larger than that of an adjacent sight hole in response to increase of a distance from a predetermined identification hole.

5. A flat-sheet shaped electrode for constituting an electrode unit which is used in a flat type image display apparatus, said flat-shaped electrode including:

a temporary fixing part at an area indented from an outer circumference of said electrode and arranged to be temporarily fixed to a temporary fixing part of an adjacent electrode via a spacer and removed after completion of a permanent fixing procedure between the adjacent electrodes.

6. A flat-sheet shaped electrode in accordance with claim 5, wherein said electrode has a projecting end part having only obtuse angle edges between a cut-line edge and edges intersecting with said cut-line edge when said temporary fixing part is cut off.

* * * * *